US009133577B2

(12) United States Patent
Fujimoto et al.

(10) Patent No.: US 9,133,577 B2
(45) **Date of Patent: *Sep. 15, 2015**

(54) CORDLESS IRON

(75) Inventors: Hiroshi Fujimoto, Shiga (JP); Kiichi Shimosaka, Shiga (JP); Yasuharu Otsuka, Shiga (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 185 days.

This patent is subject to a terminal disclaimer.

(21) Appl. No.: 13/499,578

(22) PCT Filed: Oct. 22, 2010

(86) PCT No.: PCT/JP2010/006275

§ 371 (c)(1),
(2), (4) Date: Mar. 30, 2012

(87) PCT Pub. No.: WO2011/055507

PCT Pub. Date: May 12, 2011

(65) Prior Publication Data

US 2012/0181263 A1 Jul. 19, 2012

(30) Foreign Application Priority Data

Nov. 4, 2009 (JP) ..... 2009-252604

(51) Int. Cl.

| | |
|---|---|
| ***D06F 75/40*** | (2006.01) |
| ***D06F 75/38*** | (2006.01) |
| ***D06F 75/18*** | (2006.01) |
| ***D06F 75/30*** | (2006.01) |
| ***D06F 75/34*** | (2006.01) |
| ***D06F 79/02*** | (2006.01) |
| ***D06F 75/36*** | (2006.01) |

(52) U.S. Cl.

CPC ..... *D06F 75/38* (2013.01); *D06F 75/18* (2013.01); *D06F 75/30* (2013.01); *D06F 75/34* (2013.01); *D06F 75/36* (2013.01); *D06F 79/026* (2013.01)

(58) Field of Classification Search

CPC ..... H01C 7/008; H01C 1/14; H01C 7/18; H01C 10/00; H01C 1/148; H01C 7/00; D06F 75/38; D06F 75/10; D06F 75/20; D06F 75/12; D06F 75/22; D06F 73/00; D06F 75/08; D06F 75/14; D06F 75/16; D06F 75/18; D06F 75/24; D06F 75/26; D06F 75/34; D06F 79/026; D06F 75/36; D06F 75/30; D06F 79/00; D06F 79/02; D06F 81/06

USPC ..... 219/247, 245, 246, 250, 256, 258, 259; 38/74, 75, 77.1, 77.3, 77.5, 77.6, 77.7, 38/77.9, 78.82, 77.83, 79, 82, 8, 5, 88, 93, 38/94, 96; 310/311

See application file for complete search history.

(56) References Cited

U.S. PATENT DOCUMENTS

| | | | | |
|---|---|---|---|---|
| 3,398,260 | A * | 8/1968 | Martens | 219/247 |
| 3,745,676 | A * | 7/1973 | Dikoff | 38/96 |
| 3,760,149 | A * | 9/1973 | Harsanyi | 219/247 |
| 3,942,856 | A * | 3/1976 | Mindheim et al. | 200/51.09 |
| 4,347,428 | A * | 8/1982 | Conrad et al. | 219/251 |
| 4,528,429 | A * | 7/1985 | Dobson et al. | 200/50.28 |
| 4,650,268 | A * | 3/1987 | Dobson et al. | 439/138 |
| 4,784,616 | A * | 11/1988 | Zimmermann | 439/568 |
| 4,815,992 | A * | 3/1989 | Aranzabal | 439/620.02 |
| 4,827,104 | A * | 5/1989 | Foster, Jr. | 219/251 |
| 4,943,703 | A * | 7/1990 | Duxbury | 219/247 |
| 4,948,945 | A * | 8/1990 | Wu | 219/247 |
| 5,039,838 | A * | 8/1991 | Ito et al. | 219/251 |
| 5,117,092 | A * | 5/1992 | Shimizu et al. | 219/247 |
| 5,120,934 | A * | 6/1992 | Nakada et al. | 219/247 |
| 5,142,124 | A * | 8/1992 | Driessen | 219/247 |
| 5,290,998 | A * | 3/1994 | Couch et al. | 219/247 |
| 5,414,945 | A * | 5/1995 | Freeman et al. | 38/96 |
| 5,964,601 | A * | 10/1999 | Tsurumaru et al. | 439/141 |
| 6,243,276 | B1 * | 6/2001 | Neumann | 363/53 |
| 6,857,209 | B2 * | 2/2005 | Wehrwein et al. | 38/77.1 |
| 6,917,015 | B2 * | 7/2005 | Choo | 219/247 |
| 2007/0256336 | A1 | 11/2007 | Choi | |

FOREIGN PATENT DOCUMENTS

| | | | |
|---|---|---|---|
| BE | 897206 | A2 | 11/1983 |
| EP | 0 413 367 | A1 | 2/1991 |
| GB | 2 221 925 | A | 2/1990 |
| JP | 56-083000 | U | 7/1981 |
| JP | 03-295599 | A | 12/1991 |
| JP | 09-057000 | A | 3/1997 |
| JP | 09-168700 | A | 6/1997 |
| JP | 2000-005495 | A | 1/2000 |
| JP | 2009-028384 | A | 2/2009 |
| JP | 2009-028385 | A | 2/2009 |
| JP | 2009-238055 | A | 10/2009 |

OTHER PUBLICATIONS

International Search Report for International Application No. PCT/JP2010/006275, dated Dec. 7, 2010, 1 page.
Extended European Search Report for European Application No. 10828068.6, dated Nov. 7, 2012, 6 pages.
Examination Report from European Application No. 10828068.6, dated May 10, 2013, 4 pages.

* cited by examiner

*Primary Examiner* — Eric Stapleton
(74) *Attorney, Agent, or Firm* — Brinks Gilson & Lione

(57) ABSTRACT

An iron body includes a concave power receiving portion at the rear portion of a grip and power receiving terminals in the power receiving portion. Stand includes seat where iron body is placed with the front inclined upward, convex power supply portion at the rear portion of seat, and electrodes in power supply portion. A support portion protruding vertically rearward is formed in the power receiving portion, slit where the support portion is fitted is formed on the top of power supply portion, guide portion inclining toward slit and guiding the support portion is formed at the front of power supply portion, and bulged portion protruding in an arc shape toward power receiving portion and guiding the power receiving portion is formed at the lower portion of the front of power supply portion. When iron body is placed on stand, the power receiving portion is guided to a correct position of power supply portion by guide portion and bulged portion, such that the power receiving terminals and the electrodes are reliably electrically connected.

6 Claims, 9 Drawing Sheets

CORDLESS IRON

This application is a 371 application of PCT/JP2010/006275 having an international filing date of Oct. 22, 2010, which claims priority to JP2009-252604 filed Nov. 4, 2009, the entire contents of which are incorporated herein by reference.

TECHNICAL FIELD

The present invention relates to an iron that smoothes out wrinkles in clothing, particularly, a cordless iron of which the iron body has no cord.

BACKGROUND ART

Ironing has an operation of smoothing out wrinkles by moving an iron on clothing and an operation of arranging the shape of the clothing with the iron in place. Ironing is performed by alternately repeating the operation of smoothing out wrinkles and the operation of arranging the shape of the clothing.

In order to make the ironing operation easier, there is a cordless iron of which the iron body has no power cord (for example, PTL 1). The cordless iron includes a stand with a power cord and an iron body equipped with a heater for heating the pressing surface. When the iron body is placed on the stand, the power cord of the stand and the heater of the iron body are electrically connected. That is, the heater is supplied with power only when the iron body is placed on the stand. A user separates the iron body with the pressing surface heated by the heater from the stand and performs ironing, using the remaining heat of the pressing surface. The temperature of the pressing surface gradually decreases during ironing. However, the user occasionally places back the iron body onto the stand to arrange the shape of clothing. In this state, the heater is supplied with power again and the pressing surface is heated. It is possible to perform ironing in the same way as the iron with a power cord, with the cordless iron, by performing the operation described above.

As described above, placing the iron body onto the stand is frequently performed during ironing. When the iron body is placed on the stand, the power receiving portion of the iron body and the power supply portion of the stand are fitted to each other. Accordingly, power receiving terminals of the power receiving portion and electrodes of the power supply portion are electrically connected to each other. However, when the iron body is carelessly placed on the stand, the electric connection is not reliably achieved. Further, carefully placing the iron body onto the stand in order to achieve reliable electric connection was troublesome for the user.

PTL 1 Japanese Patent Unexamined Publication No. 2000-5495

SUMMARY OF THE INVENTION

The present invention provides a cordless iron in which power receiving terminals of a power receiving portion and electrodes of a power supply portion are reliably electrically connected to each other. A cordless iron of the present invention includes an iron body that includes a base, a grip disposed above the base, a concave power receiving portion formed at the rear portion of the grip, and power receiving terminals disposed in the power receiving portion. Further, the cordless iron of the present invention includes: a stand including a seat where the iron body is placed with the front of the base inclining upward, a convex power supply portion formed at the rear portion of the seat, and electrodes disposed in the power supply portion. Further, the cordless iron of the present invention includes a support portion having a plate shape and protruding rearward in a direction perpendicular to the bottom of the base, in the power receiving portion, a slit formed in a groove shape to fit the support portion, on the top of the power supply portion, a guide portion inclining toward the slit on the front of the power supply portion and guides the support portion, and a bulged portion protruding in an arc shape toward the power receiving portion and guiding the power receiving portion, at the lower portion of the front of the power supply portion. Further, in the cordless iron of the present invention, when the iron body is placed on the stand, the power receiving portion and the power supply portion are fitted to each other, and the power receiving terminals and the electrodes are electrically connected to each other.

By this configuration, the power receiving portion is guided to the correct position of the power supply portion, such that the power receiving terminals of the power receiving portion and the electrodes of the power supply portion are reliably and electrically connected to each other.

DETAILED DESCRIPTION OF THE PREFERRED EMBODIMENTS

First Exemplary Embodiment

Figure 1:
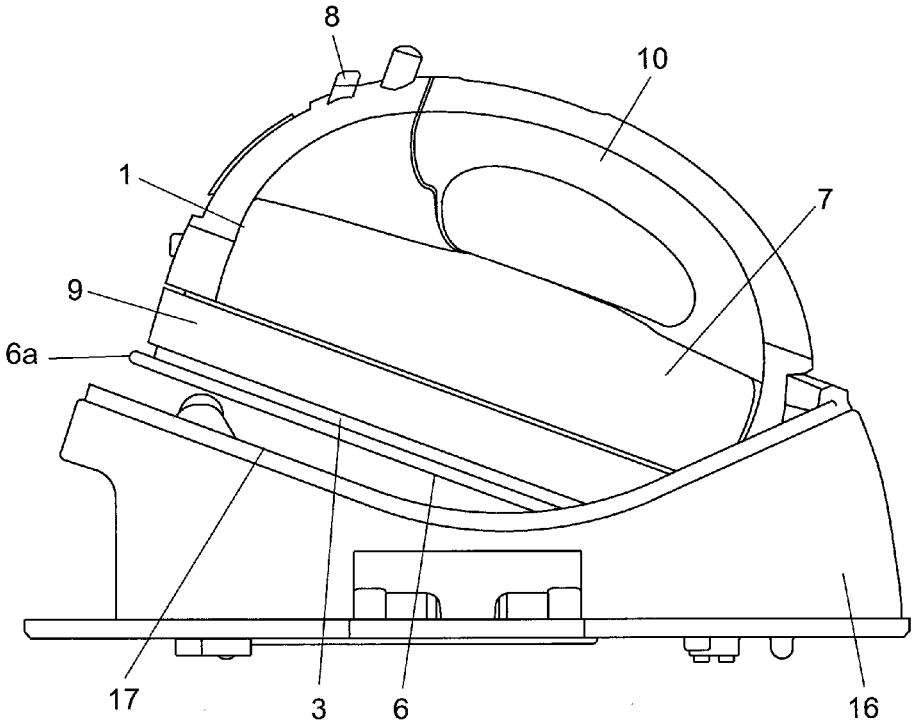
FIG. 1 is a side view of a cordless iron according to a first embodiment of the present invention.
Figure 2:
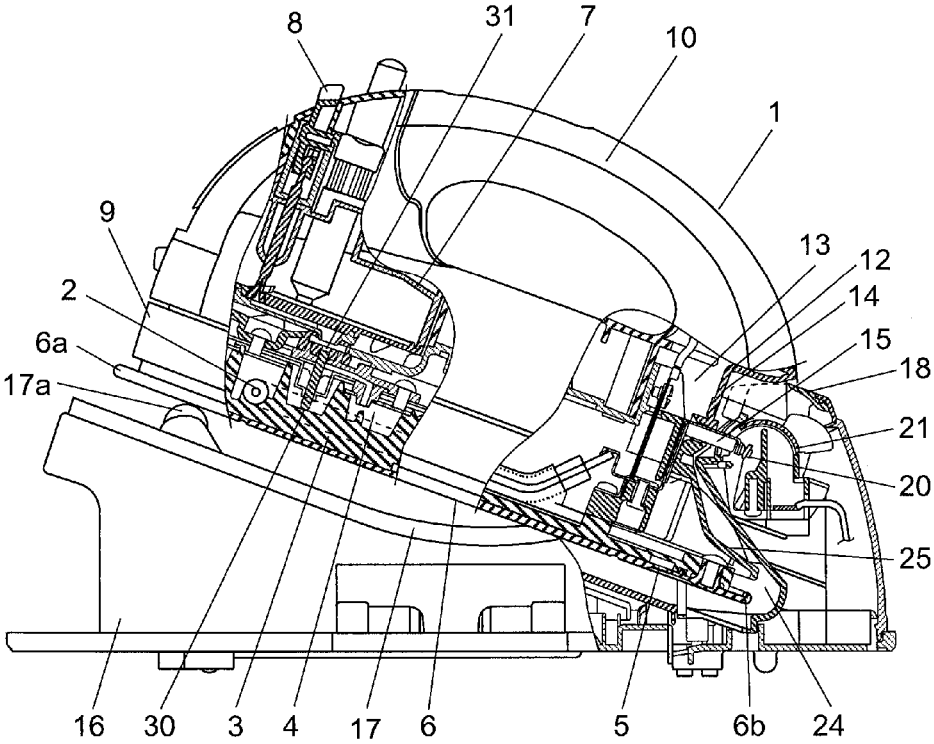
FIG. 2 is a partial cross-sectional view of the cordless iron according to the embodiment.
Figure 3:
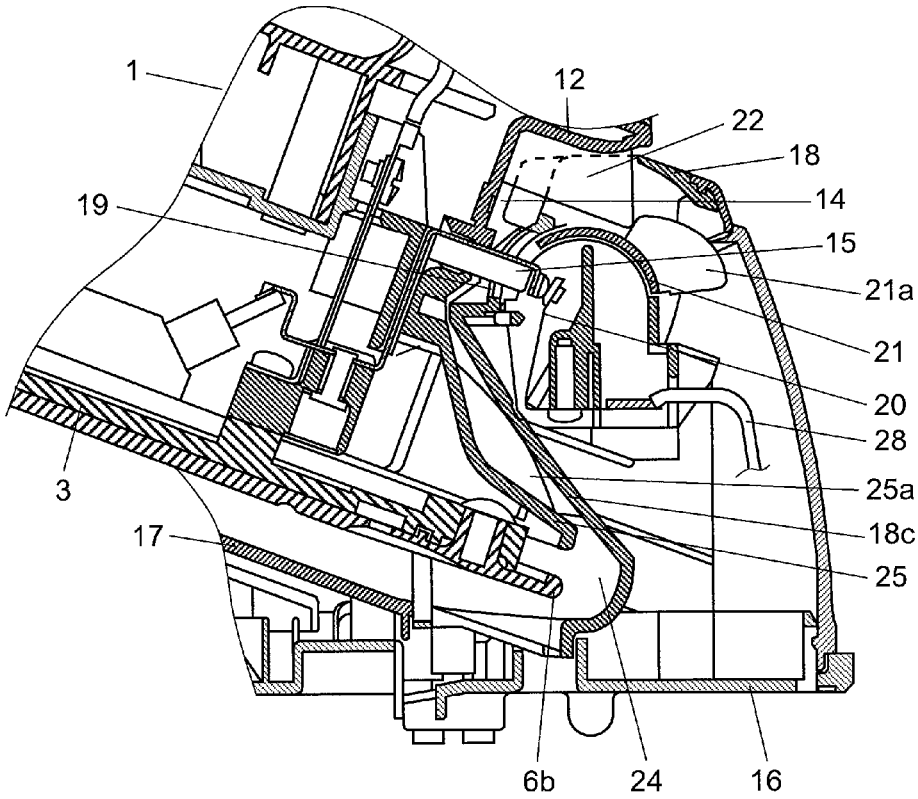
FIG. 3 is a cross-sectional view showing main parts of the cordless iron according to the embodiment.
Figure 4:
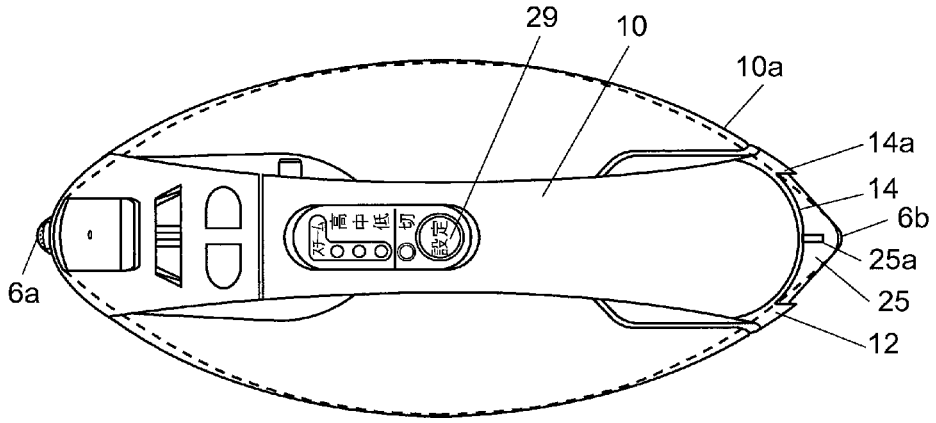
FIG. 4 is a top view of an iron body of the cordless iron according to the embodiment.
Figure 5:
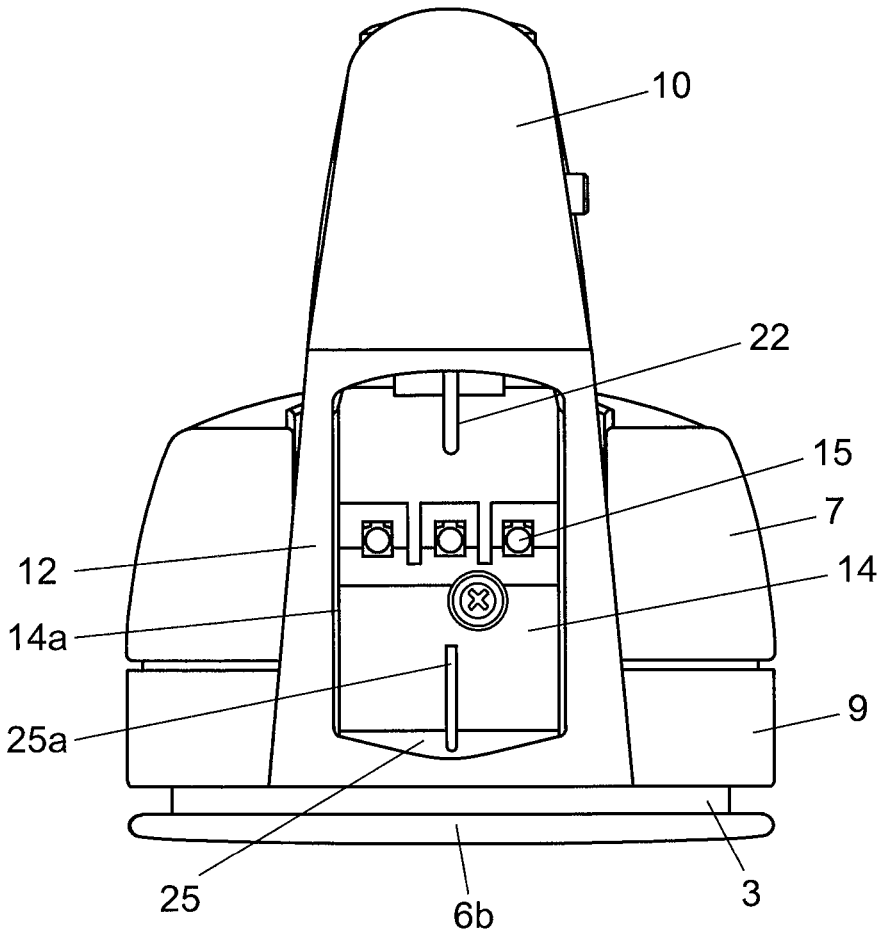
FIG. 5 is a rear view the iron body of the cordless iron according to the embodiment.
Figure 6:
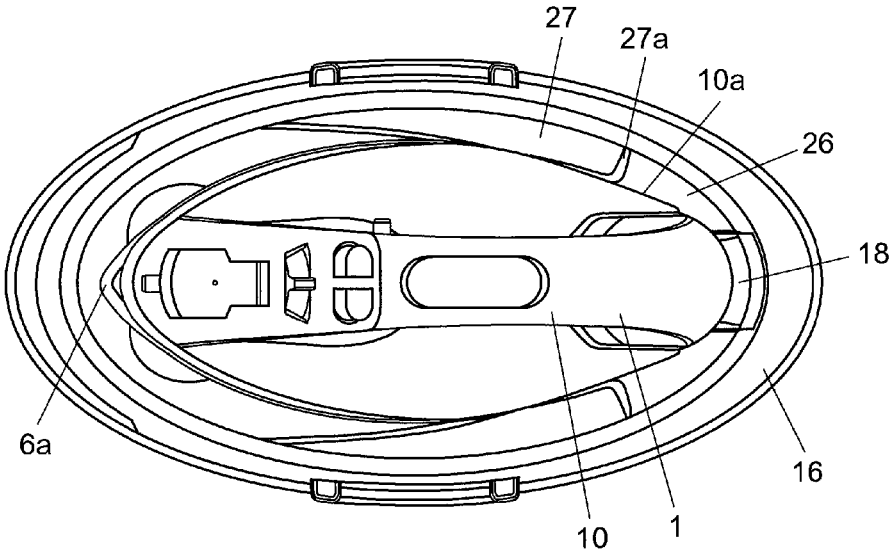
FIG. 6 is a top view of the cordless iron according to the embodiment.
Figure 7:
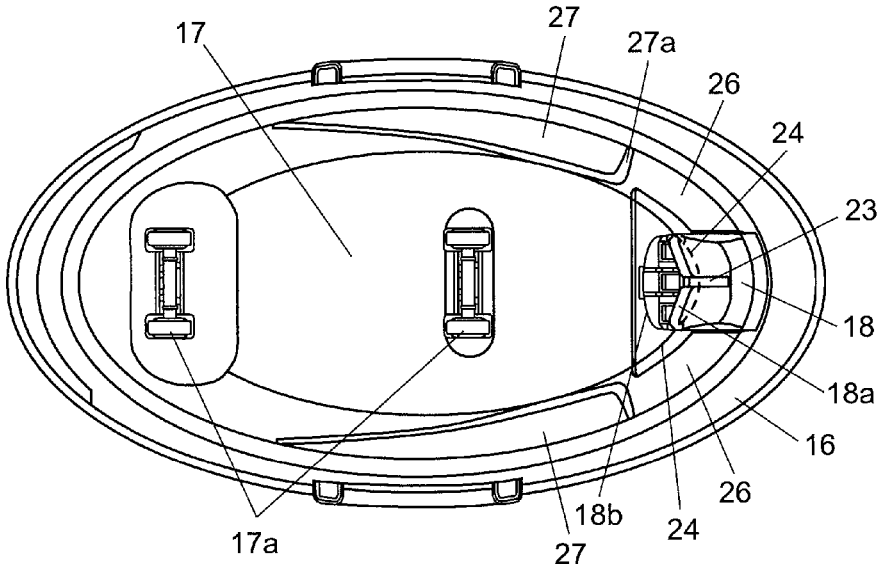
FIG. 7 is a top view of a stand for the cordless iron according to the embodiment.
Figure 8:
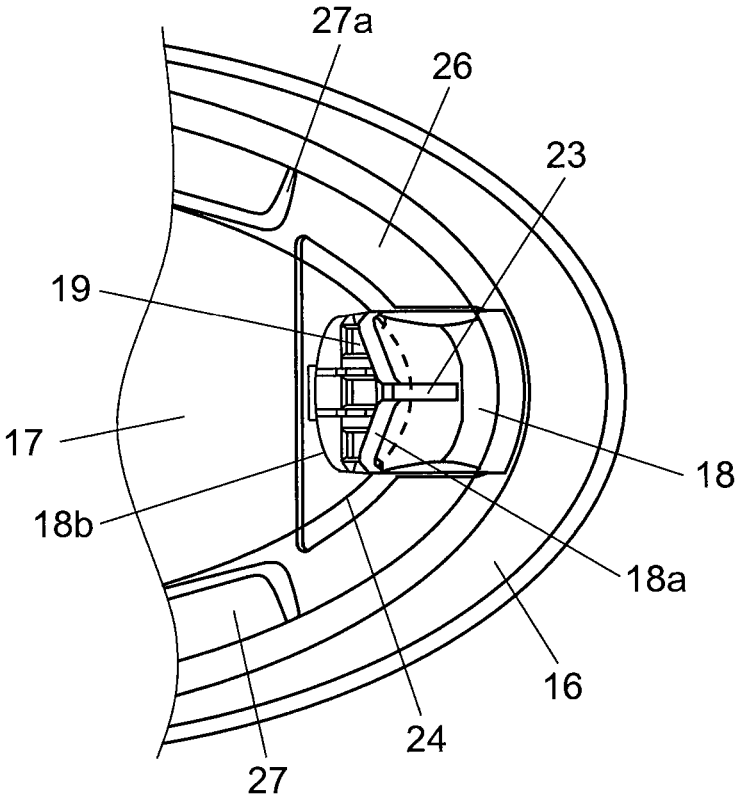
FIG. 8 is a top view showing main parts of the stand for the cordless iron according to the embodiment.

FIG. 1 is a side view of cordless iron 1 according to a first embodiment of the present invention. FIG. 2 is a partial cross-sectional view of the cordless iron. FIG. 3 is a cross-sectional view showing main parts of the cordless iron. FIG. 4 is a top view of an iron body of the cordless iron. FIG. 5 is a rear view of the iron body of the cordless iron. FIG. 6 is a top view of the cordless iron. FIG. 7 is a top view of a stand for the cordless iron. FIG. 8 is a top view showing main parts of the stand for the cordless iron.

Iron body 1 of a cordless iron includes base 3 that is heated by embedded heater 2. Pressing surface 6 is disposed on the bottom of base 3. Front end portion 6*a* and rear end portion 6*b* of pressing surface 6 are pointed. Concave vaporizing chamber 4 is formed on the top of base 3. Tank 7 made of resin stores water that is the basis of steam. The water is supplied and blocked to vaporizing chamber 4 from tank 7 by operating steam button 8. Steam generated in vaporizing chamber 4 is ejected from steam hole 5 formed through pressing surface 6. Steam hole 5 is formed across a wide range of pressing surface 6, including the peripheries of front end portion 6*a* and rear end portion 6*b*. Further, the top of base 3 is covered by insulating plate 9. Grip 10 made of resin is disposed above base 3, that is, insulating plate 9.

Terminal portion 13 is disposed at rear portion of iron body 1. Grip 10 is equipped with a grip backplate 12 to cover terminal portion 13 from behind. Accordingly, power receiving portion 14 shaped by recessing the rear surface of iron body 1 inward is formed. Power receiving terminals 15 electrically connected with heater 2 are disposed protruding toward the rear of iron body 1, in power receiving portion 14.

Iron body 1 is placed on stand 16. Seat 17 having support bodies 17*a* is disposed in stand 16. Pressing surface 6 of base 3 of iron body 1 is supported from below by support bodies 17*a*, which are composed of rollers. Iron body 1 is placed with the front inclining upward at 20 to 30°. The inclination angle allows a user to easily place and separate iron body 1.

As shown in FIG. 7, support bodies 17*a* are disposed at two positions in the front-rear direction and support pressing surface 6 at position spaced in the front-rear direction. Further, when iron body 1 is placed on seat 17, iron body 1 is naturally moved back by the rollers of support bodies 17*a*. Accordingly, iron body 1 is stably supported on stand 16.

Convex power supply portion 18 fitted in power receiving portion 14 of the placed iron body 1 is formed at the rear portion of stand 16, that is, the rear portion of seat 17. Holes 19 in which power receiving terminals 15 are inserted when iron body 1 is placed are formed through the front of power supply portion 18. One hole 19 is formed at each of the left and right of power supply portion 18. Power receiving terminals 15 inserted from holes 19 are electrically connected to electrodes 20 disposed in power supply portion 18.

Shutter 21 that is pushed by a spring (not shown) to close holes 19 is disposed in power supply portion 18. Holes 19 are closed by shutter 21, when iron body 1 is separated from stand 16. When iron body 1 is seated on stand 16, support portion 22 disposed at power receiving portion 14 presses backward an operating portion 21*a* of shutter 21. Accordingly, support portion 22 turns shutter 21 against the pushing force of the spring and holes 19 are opened. As holes 19 are opened, power receiving terminals 15 are inserted and electrically connected with electrodes 20.

Support portion 22 is disposed at the upper portion in power receiving portion 14, above power receiving terminals 15. Support portion 22 is integrally formed with grip backplate 12 in a thin plate shape, vertically and protruding backward from iron body 1.

Slit 23 which is a groove where support portion 22 is fitted is formed on the top of power supply portion 18. Slit 23 is formed in the movement direction of iron body 1, that is, in the front-rear direction. Therefore, when iron body 1 is placed on stand 16, the position of iron body 1 is restricted to the left and right, such that iron body 1 is stable.

Guide portion 18*a* inclining left and right and forward from the front end portion of slit 23 is formed at the inlet of slit 23, that is, at the front of power supply portion 18. Guide portion 18*a* is formed substantially in a V-shape with inclining surfaces. By the shape, when iron body 1 is placed on stand 16, the front end of support portion 22 slides on the inclining surfaces toward the inlet at the front end portion of slit 23, in contact with the inclining surfaces of guide portion 18*a*. Therefore, support portion 22 is guided to slit 23.

Bulged portion 18*b* protruding in an arc shape toward power receiving portion 14 when iron body 1 is placed is formed at the lower portion of the front of power supply portion 18, that is, under guide portion 18*a*. When iron body 1 is placed on stand 16, opening end 14*a* of power receiving portion 14 slides left and right along the arc surface, in contact with bulged portion 18*b*. Therefore, power receiving portion 14 is guided to power supply portion 18. Guide portion 18*a* is positioned above holes 19. Bulged portion 18*b* is positioned under holes 19.

Accordingly, when iron body 1 is placed on stand 16, power supply portion 18 of stand 16 is reliably fitted in power receiving portion 14 of iron body 1 by guide portion 18*a* disposed at the upper portion of power supply portion 18 and bulged portion 18*b* disposed at the lower portion. That is, the positional deviation at an angle to the left and right of power receiving portion 14 is corrected. Accordingly, power receiving terminals 15 and electrodes 20 are reliably electrically connected.

Receiving portion 24 that receives rear end portion 6*b* of pressing surface 6 of base 3 where iron body 1 is placed is disposed under power supply portion 18. The joint of power receiving terminals 15 and electrodes 20 is positioned forward by rear end portion 6*b*, with rear end portion 6*b* positioned in receiving portion 24. That is, the front ends of power receiving terminals 15 are positioned ahead of rear end portion 6*b*, when iron body 1 is placed on stand 16.

Receiving portion 24 is formed with the top of seat 17 tapered rearward. Accordingly, pointed rear end portion 6*b* is received in a compact size under power supply portion 18. Further, iron body 1 is also formed with a side 10*a* of grip 10 tapered toward open end 14*a* of power receiving portion 14.

Cover 25 that covers the top of rear end portion 6*b* is disposed under power receiving terminals 15. Cover 25 is formed by extending downward grip backplate 12 where power receiving portion 14 is formed. That is, cover 25 forms a portion of grip 10. The outer edge of cover 25 is formed along the outer edge of base 3. That is, cover 25 covers the upper portion of rear end portion 6*b*, substantially in the same shape as rear end portion 6*b*.

Heat dissipating portions 26 are formed at both sides of power supply portion 18, at the rear portion of stand 16. Heat dissipating portions 26 communicate with both sides of power supply portion 18 through receiving portion 24. When iron body 1 is placed on stand 16, rear end portion 6*b* is positioned in receiving portion 24. Rear end portion 6*b* is heated at a high temperature together with the entire pressing surface 6. Heat of rear end portion 6*b* is discharged outside from receiving portion 24 by heat dissipating portion 26, such that abnormal overheating of power supply portion 18 is suppressed.

Guides 27 are formed at both sides of seat 17. The gap between guides 27 at both sides decreases toward power supply portion 18. Heat dissipating portion 26 is formed between rear ends 27*a* of guides 27 and power supply portion 18. Accordingly, heat dissipating portion 26 has a sufficient heat dissipation space. Iron body 1 is placed on stand 16, as side 10*a* of grip 10 is guided by guides 27. Accordingly, power receiving portion 14 of iron body 1 is reliably guided to power supply portion 18 of stand 16.

Receiving portion-upper wall 18*c* forming the top of receiving portion 24 is formed to incline upward toward the front of stand 16. The rear portion of receiving portion-upper wall 18*c* extends behind rear end portion 6*b* such that rear end portion 6*b* is received in receiving portion 24. Rib 25*a* protruding in an arc shape toward receiving portion-upper wall 18*c* of receiving portion 24 is disposed on cover 25 of iron body 1. When iron body 1 is placed onto or separated from stand 16, the top of rib 25*a* moves in contact with receiving portion-upper wall 18*c*. Accordingly, iron body 1 is smoothly attached/detached.

Next, the movement and operation of the cordless iron of the embodiment are described. First, a user places iron body 1 onto seat 17 of stand 16. That is, when pressing surface 6 is placed on support bodies 17*a*, power receiving terminals 15 electrically connected to electrodes 20. Accordingly, electricity is supplied to electrodes 20 through power cord 28.

The temperature of pressing surface 6 is set by a temperature setting unit 29 disposed at grip 10. Heater 2 heats base 3 such that pressing surface 6 reaches a set temperature (for example, 200° C.). As base 3 is heated, vaporizing chamber 4 is also heated. When the temperature of vaporizing chamber 4 reaches the vaporization temperature of water, bimetal 30 turns around and heat-responsive valve 31 opens. In this state, when steam button 8 is pushed, the water stored in tank 7 drops into vaporizing chamber 4. The water dropping in the vaporizing chamber 4 vaporizes into steam and discharged from steam hole 5 formed through the pressing surface 6.

Receiving portion 24 that receives rear end portion 6*b* of iron body 1 is disposed under power supply portion 18. By this configuration, when iron body 1 is placed on stand 16, the joint of power receiving terminals 15 and electrodes 20 is positioned ahead of rear end portion 6*b*. That is, pressing surface 6 extends to the rear end of iron body 1. Accordingly, it is possible to make rear end portion 6*b* pointed without largely reducing the area of pressing surface 6. Since it is possible to ensure the area of pressing surface 6, as described above, it is possible to ensure thermal capacity of pressing surface 6. That is, it is possible to make rear end portion 6*b* pointed, for a cordless iron using remaining heat. Therefore, in ironing that uses steam, a decrease in temperature of pressing surface 6 is suppressed, such that a cordless iron that is convenient to use is achieved.

A user separates iron body 1 from stand 16, with grip 10 in a hand, for ironing. Further, the user moves forward and backward iron body 1 while pressing down clothing. When iron body 1 moves forward, the clothing is pressed and wrinkles of the clothing are smoothed out by pointed front end portion 6*a*. Further, as shown in FIG. 4, rear end portion 6*b* has a pointed shape, the same as front end portion 6*a*. Therefore, even though iron body 1 moves back, similar to the forward movement, the clothing is pressed and wrinkles of the clothing are smoothed out. Accordingly, return creases are not made. That is, similar to the forward movement of iron body 1, it is possible to move iron body 1 in the direction of rear end portion 6*b*, which makes ironing easy.

Rear end portion 6*b* protrudes rearward further than the rear ends of power receiving terminals 15. Accordingly, it is possible to see rear end portion 6*b* even though iron body 1 moves back. That is, similar to front end portion 6*a* when iron body 1 moves forward, it is possible to see rear end portion 6*b* even during backward movement, such that ironing can be efficiently performed in the front-rear direction.

It is possible to move forward iron body 1, with rear end portion 6*b* at the front, when holding iron body 1 with the other hand. That is, it is not necessary to change the direction of iron body 1 when holding iron body 1 with the other hand.

Further, side 10*a* of grip 10 is tapered toward open end 14*a* of power receiving portion 14. Therefore, rear end portion 6*b* is reliably seen, not only in backward ironing, but in forward movement with rear end portion 6*b* at the front. That is, usability when moving iron body 1 in the direction of rear end portion 6*b* is improved.

Open end 14*a* of power receiving portion 14 is positioned around rear end portion 6*b*. Therefore, open end 14*a* is necessarily small. Power supply portion 18 where open end 14*a* is fitted from outside is also formed small in the left-right direction.

In the embodiment, guide portion 18*a* and bulged portion 18*b* that guide power receiving portion 14 to power supply portion 18 are disposed at the front of power supply portion 18. Slit 23 where support portion 22 is fitted is disposed at the center of the top of power supply portion 18. Support portion 22 that is fitted into slit 23 and rib 25*a* that comes in contact with receiving portion-upper wall 18*c* of power supply portion 18 are disposed substantially at the center of power receiving portion 14. Similarly, power supply portion 18 is formed small in the left-right direction and side 10*a* of grip 10 is tapered toward rear end portion 6*b*.

Since receiving portion 24 is tapered toward the rear portion of seat 17, when iron body 1 is placed on stand 16, power receiving portion 14 of iron body 1 is guided and fitted on power supply portion 18. Therefore, electrodes 20 of power supply portion 18 and power receiving terminals 15 of power receiving portion 14 are reliably connected. Since receiving portion 24 is tapered toward the rear portion of seat 17, receiving portion 24 is formed in a compact size at the rear portion of stand 16.

Since cover 25 covering the top of rear end portion 6*b* is disposed under power receiving terminals 15, heat from rear end portion 6*b* that is heated at a high temperature is blocked. Abnormal overheating of power supply portion 18 is suppressed by this configuration. Further, by the configuration, when iron body 1 is placed onto and separated from stand 16, it is possible to prevent rear end portion 6*b* from coming in contact with power supply portion 18.

The outer edge of cover 25 is formed along the outer edge of base 3. By this configuration, it is possible to protect power supply portion 18 and prevent overheating of power supply portion 18 while easily see rear end portion 6*b*.

Cover 25 is formed by extending downward power receiving portion 14 that is a portion of grip 10. By this configuration, when iron body 1 is placed on stand 16, cover 25 covers power supply portion 18 from the front. Accordingly, power supply portion 18 is protected and overheating is prevented, even if iron body 1 is frequently placed onto and separated from stand 16 during ironing.

Heat dissipating portions 26 that discharge heat of rear end portion 6*b* to the outside from receiving portion 24 are formed at both sides of power supply portion 18. By this configuration, the heat of rear end portion 6*b* is dissipated and overheating of power supply portion 18 is prevented, even if iron body 1 is frequently placed onto stand 16 during ironing.

Heat dissipating portions 26 communicate with both sides of power supply portion 18 through receiving portion 24. By this configuration, the air in receiving portion 24 smoothly flows. That is, efficiency of heat dissipation is improved and the internal temperature of receiving portion 24 is prevented from increasing.

Guides 27 that guide power receiving portion 14 to power supply portion 18 are disposed at both sides of seat 17. Since heat dissipating portion 26 is formed between rear ends 27*a* of guides 27 and power supply portion 18, the air in receiving portion 24 is efficiently discharged to the outside from the closer distance.

Power supply portion 18 is formed by inclining upward the front of receiving portion-upper wall 18*c* that is the top of receiving portion 24. By this configuration, it is possible to easily separate iron body 1 from stand 16. The inclination angle of the front of receiving portion-upper wall 18*c* is larger than the inclination angle of the front of pressing surface 6. Therefore, when iron body 1 is separated from stand 16, even if iron body 1 is separated while being lifted upward, rear end portion 6*b* does not come in contact with receiving portion-upper wall 18*c* of power supply portion 18. That is, it becomes easy to attach/detach iron body 1 to/from stand 16.

Bulged portion 18*b* that protrudes in an arc shape toward power receiving portion 14 is formed at power supply portion 18. By this configuration, even if receiving portion 14 is biased to the left and right, when iron body 1 is placed on stand 16, open end 14*a* of power receiving portion 14 slides left and right along the arc surface, in contact with bulged portion 18*b*. Accordingly, iron body 1 is moved to a predetermined position and the position is restricted, such that power receiving portion 14 is reliably fitted on power supply portion 18.

Support portion 22 having a plate shape protruding rearward and in the direction perpendicular to the bottom of base 3 is disposed inside power receiving portion 14. Slit 23 which is a groove where the support portion 22 is fitted is disposed on the top of the power supply portion 18. Guide portion 18*a* inclining toward slit 23 is disposed on the front of power supply portion 18. By this configuration, support portion 22 is fitted in slit 23 and the position of iron body 1 is restricted. Accordingly, iron body 1 is placed at a predetermined position on stand 16 and power receiving terminals 15 and electrodes 20 are reliably connected. Since support portion 22 is fitted with a predetermined length with respect to slit 23, the position of iron body 1 is restricted and it is possible to easily separate iron body 1 from stand 16.

Guide portion 18*a* inclines forward from slit 23 and is formed substantially in a V-shape to be open left and right. By this configuration, when iron body 1 is placed on stand 16, the front end of support portion 22 is guided to slit 23 while sliding on the inclining surfaces toward the inlet of slit 23, in contact with the inclining surfaces of guide portion 18*a*. Therefore, support portion 22 is reliably fitted in slit 23.

As described above, iron body 1 is guided inside by guide portion 18*a* at the upper portion of power supply portion 18 and guided outside by bulged portion 18*b* at the lower portion of power supply portion 18. That is, iron body 1 is reliably positioned from the upper portion and the lower portion when placed on stand 16, and power receiving terminals 15 and electrodes 20 are reliably connected.

That is, even if iron body 1 is placed on stand 16 with power receiving portion 14 inclining in the left-right direction, support portion 22 is in contact with inclining guide portion 18*a* and the upper portion of power receiving portion 14 is guided inside. Further, even if iron body 1 is placed on stand 16 with power receiving portion 14 biased in the left-right direction, bulged portion 18*b* is in contact with power receiving portion 14 and the lower portion of power receiving portion 14 is guided outside. Accordingly, even if iron body 1 is placed on stand 16 carelessly, inclination or deviation in the left-right direction is corrected to the correct position by guide portion 18*a* and bulged portion 18*b*. Accordingly, usability of the cordless iron is improved.

Second Exemplary Embodiment

Figure 9:
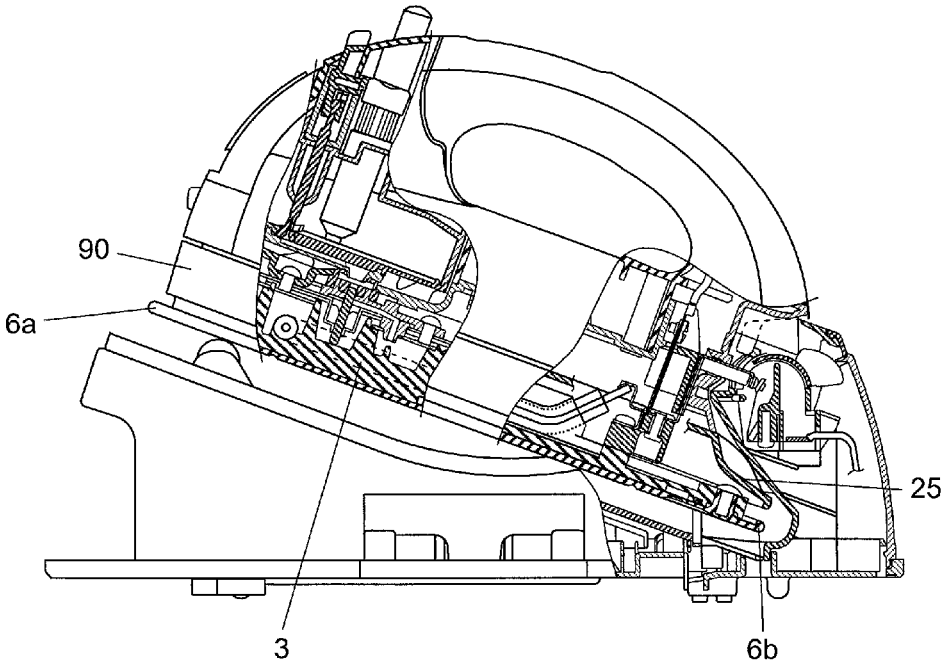
FIG. 9 is a partial cross-sectional view of a cordless iron according to a second embodiment of the present invention.

FIG. 9 is a partial cross-sectional view of a cordless iron according to a second embodiment of the present invention. The cordless iron of the embodiment is different from the first embodiment in that cover 25 covering the top of rear end portion 6*b* is implemented by insulating plate 90 covering the top of base 3. The other configurations are the same as those of the first embodiment.

According to the configuration of the embodiment, it is possible to cover the top from front end portion 6*a* to rear end portion 6*b* with insulating plate 90, without a gap. Therefore, it is possible to improve insulating effect of base 3 and simplify the configuration.

Third Exemplary Embodiment

Figure 10:
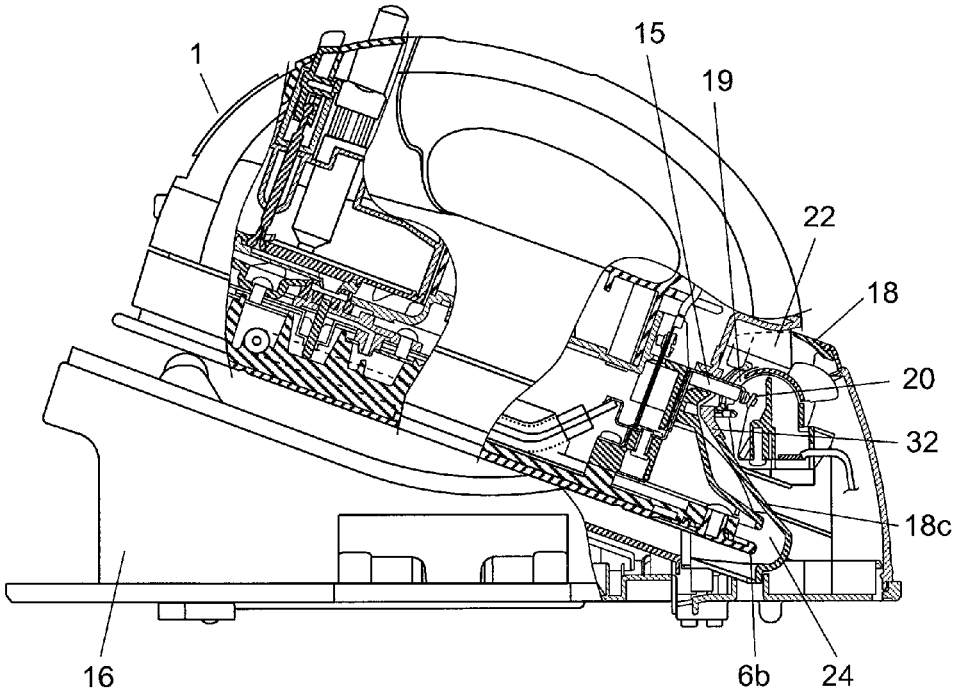
FIG. 10 is a cross-sectional view of a cordless iron according to a third embodiment of the present invention.

FIG. 10 is a partial cross-sectional view of a cordless iron according to a third embodiment of the present invention. The cordless iron of the embodiment is different from the first embodiment in that protection body 32 is disposed on receiving portion-upper wall 18*c* of power supply portion 18 that forms the top of receiving portion 24. The other configurations are the same as those of the first embodiment.

Protection body 32 is made of thermally-resistant rubber. When iron body 1 is separated from stand 16, rear end portion 6*b* is prevented from coming in contact with receiving portion-upper wall 18*c* of power supply portion 18 by protection body 32.

When iron body 1 is placed on stand 16, power receiving terminals 15 are connected with electrodes 20 through holes 19 of power supply portion 18. Support portion 22 is fitted in slit 23 of power supply portion 18. When iron body 1 is separated, power receiving terminals 15 are separated from holes 19 and support portion 22 is separated from slit 23. In this process, the position of iron body 1 is not restricted with respect to stand 16.

Since the positional restriction is removed, rear end portion 6*b* easily comes in contact with receiving portion-upper wall 18*c* of power supply portion 18, in receiving portion 24. Protection body 32 prevents rear end portion 6*b* and receiving portion-upper wall 18*c* from coming in contact with each other. Therefore, it is effective to dispose protection body 32 at the upper portion of receiving portion-upper wall 18*c* where rear end portion 6*b* and receiving portion-upper wall 18*c* easily come in contact with each other after the position of iron body 1 is not restricted.

According to the configurations described above, shock when iron body 1 is separated is attenuated. Further, it is possible to protect power supply portion 18 from heat and shock.

INDUSTRIAL APPLICABILITY

As described above, the present invention is useful as a cordless iron, because the iron body is placed at the correct position when being placed on the stand.

The invention claimed is:

1. A cordless iron comprising:

(I) an iron body having a pressing surface extensive in a longitudinal direction and having a front end portion and a rear end portion arranged along the longitudinal direction, the iron body comprising:

(I-i) a base having a bottom surface on which the pressing surface is disposed, the pressing surface having front and rear pointing edges, respectively, at longitudinal ends thereof;

(I-ii) a concave power receiving portion located above the base in the rear end portion of the iron body, the concave power receiving portion comprising power receiving terminals;

(I-iii) a positioning plate being extensive vertically and in the longitudinal direction in the concave power receiving portion;

(I-iv) a cover having a sloped surface above the base, the sloped surface being extensive in the longitudinal direction continuously from the concave power receiving portion and sloped downwardly, while getting narrower in a lateral direction, towards the rear pointing edge of the pressing surface; and (I-v) a rib extensive on the sloped surface of the cover vertically and in the longitudinal direction and having a curved edge; and (II) a stand having a bottom surface and first and second ends along a reference direction angled from the bottom surface, the stand further comprising:

(II-i) a seat formed in the stand in the reference direction to receive the iron body therein in such a manner that the longitudinal direction of the iron body is in agreement with the reference direction of the stand, and the front pointing edge of the pressing surface of the iron body is situated on a side of the first end of the stand, while the rear pointing edge of the pressing surface of the iron body is situated on a side of the second end of the stand, wherein the seat is configured to receive the iron body in a position inclined along the reference direction such that the front end portion of the iron body is situated vertically higher than the rear end portion thereof;

(II-ii) a receiving portion having an upper wall disposed over the seat on the side of the second end of the stand and sloped downwardly towards the second end of the stand to form a receiving space over the seat on the side of the second end of the stand, the receiving space being configured to receive the rear end portion of the iron body when the iron body is positioned in the seat, wherein when the iron body is being positioned in the seat, the curved edge of the rib is in contact with the upper wall of the receiving portion to enable smooth movement of the cover inside the receiving space;

(II-iii) a convex power supply portion comprising electrodes connectable with the power receiving terminals of the concave power receiving portion, wherein the convex power supply portion is located above the receiving portion on the side of the second end of the stand and configured such that when the iron body is positioned in the seat, the convex power supply portion is partially received in the concave power receiving portion of the iron body, and the electrodes of the convex power supply portion are in electrical contact with the power receiving terminals of the concave power receiving portion, and further wherein the power receiving terminals of the concave power receiving portion and the electrodes of the convex power supply portion are configured such that when the iron body is positioned in the seat, the electrodes of the convex power supply portion are in electrical contact with the power receiving terminals of the concave power receiving portion at locations which are projectable perpendicularly onto the base between the front and rear pointing edges of the pressing surface, (II-iv) a slit formed vertically in an upper portion of the convex power supply portion, wherein the slit is dimensioned and positioned such that when the iron body is positioned in the seat, the positioning plate is received in the slit; and (II-v) a plate guide provided to generally face the first end of the stand and include the slit therein, the plate guide being shaped to converge at the slit, wherein when the iron body is being positioned in the seat, the plate guide slidably guides the petitioning plate towards the slit to position the concave power receiving portion relative to the convex power supply portion in order to establish connection between the electrodes of the convex power supply portion and the power receiving terminals of the concave power receiving portion.

2. The cordless iron of claim 1, wherein the first and second surfaces of the plate guide arranged in a V-shape converging towards the slit.

3. The cordless iron of claim 1, wherein the pressing surface has a contour formed by two arcs connected at the front and rear pointing edges.

4. The cordless iron of claim 1, wherein the seat comprises:

a first side extending between the first and second ends of the stand and a second side extending between the first and second ends of the stand with a space defined between the first and second sides; and a guide located on each of the first and second sides of the seat and extending away from the convex power supply portion.

5. The cordless iron of claim 4, wherein the guides run on the first and second sides, respectively, in such a manner that a space between the guides in a direction perpendicular to the reference direction gradually decreases towards the second end of the stand.

6. The cordless iron of claim 1, wherein the rib and the positioning plate are approximately aligned with a center of the concave power receiving portion in the lateral direction.

* * * * *